US005517743A

United States Patent [19]

Liebig et al.

[11] Patent Number: 5,517,743

[45] Date of Patent: May 21, 1996

[54] METHOD AND APPARATUS FOR JOINING SUPERPOSES METAL SHEETS

[75] Inventors: Hanns P. Liebig; Peter Sack, both of Hamburg, Germany

[73] Assignee: Eckold GmbH & Co. KG, St. Andreasberg, Germany

[21] Appl. No.: 306,908

[22] Filed: Sep. 15, 1994

Related U.S. Application Data

[63] Continuation of Ser. No. 149,076, Nov. 9, 1993, abandoned.

[30] Foreign Application Priority Data

Dec. 5, 1992 [DE] Germany ..... 42 40 970.5

[51] Int. Cl.[6] ..... B21D 31/06; B21D 37/12; B21D 39/03; B23P 11/02

[52] U.S. Cl. ..... 29/521; 29/243.519; 29/509; 29/522.1; 72/354.2; 72/379.2

[58] Field of Search ..... 29/21.1, 243.518, 29/243.519, 432, 432.1, 432.2, 509, 512, 521, 522.1, 524; 72/336, 348, 350, 351, 352, 354.2, 450, 451, 465, 363, 379.2

[56] References Cited

U.S. PATENT DOCUMENTS

| | | | |
|---|---|---|---|
| 3,602,980 | 9/1971 | Heffner | 29/509 |
| 3,615,274 | 10/1971 | Belada | 29/521 X |
| 3,981,064 | 9/1976 | Hafner | 29/432 |
| 4,160,476 | 7/1979 | Ashton et al. | 29/521 X |
| 4,306,511 | 12/1981 | Ashby et al. | 29/521 X |
| 4,601,090 | 7/1986 | Gunter | 29/243.5 |
| 4,757,609 | 7/1988 | Sawdon | 72/465 X |
| 4,825,525 | 5/1989 | Obrecht et al. | 29/21.1 X |
| 4,831,711 | 5/1989 | Rapp | 29/521 X |
| 4,896,414 | 1/1990 | Hafner | 29/432 |
| 4,897,912 | 2/1990 | Slisinski | 72/354 X |
| 5,051,020 | 9/1991 | Schleicher | 29/522.1 X |
| 5,392,629 | 2/1995 | Goss et al. | 72/379.2 X |

FOREIGN PATENT DOCUMENTS

| | | | |
|---|---|---|---|
| 0284902 | 4/1987 | European Pat. Off. . | |
| 0282902 | 9/1988 | European Pat. Off. . | |
| 3726392 | 2/1989 | Germany | 29/521 |
| 1224080 | 4/1986 | U.S.S.R. | 72/354.2 |
| 2189175 | 10/1987 | United Kingdom . | |

*Primary Examiner*—Peter Vo

*Attorney, Agent, or Firm*—Townsend and Townsend and Crew

[57] ABSTRACT

A method and a tool set for joining superposed metal sheets are disclosed. In a first step, a preferably ring-shaped free space is provided by dislocating material of at least one sheet. Thereafter, material of all sheets is squeezed within the confines of the free space whereby material flows laterally into the free space producing an interengaging form lock.

10 Claims, 2 Drawing Sheets

METHOD AND APPARATUS FOR JOINING SUPERPOSES METAL SHEETS

This is a Continuation of application Ser. No. 08/149,076, filed Nov. 9, 1993, now abandoned.

BACKGROUND OF THE INVENTION

The present invention relates to a method for joining a plurality of superposed metal sheets by local plastic deformation so that an interengaging connection is formed.

A typical method of this kind is disclosed in U.S. Pat. No. 4,601,090, particularly in FIGS. 8, 9 and 11 through 15. A predetermined volume of sheet material is displaced, by means of appropriate dies, in a direction generally orthogonal to the sheet surfaces. The protuberance so formed is then squeezed causing the metal material to cold-flow laterally thereby forming the interengaging connection. The joining element so produced remains projected beyond the sheet surface. Such a projection is often considered to be a disadvantage both functionally and aesthetically.

For this reason attempts have been made to flatten such joints, as disclosed in European Patent Application 282 902 which also discloses some tools suited for this kind of joining technique.

Therefore, it is an object of the present invention to provide a method of the general nature set forth above wherein the aspect of the joint is improved in that the interengagement of the sheets occurs within the volume delimited by the outer sheet surfaces.

SUMMARY OF THE INVENTION

According to the invention, an improved method is provided for joining superposed metal sheets. The method comprises producing a free space in at least one of the sheets by local plastic deformation. Preferably, such free space has the shape of a circular groove or channel. An interengaging connection is then formed by subsequent plastic deformation of the sheets into the free space. When the free space has the shape of a channel, the volume encircled by the free space is squeezed so that cold flux occurs tending to fill the free space.

The present invention also provides for a tool set suited to implement the method of the invention.

Embodiments of the invention are illustrated in the accompanying drawings and will be explained in detail hereinafter.

DESCRIPTION OF SPECIFIC EMBODIMENTS

The method and apparatus of the present invention allow for the joining of a plurality of superposed metal sheets. In a typical process two metal sheets are joined. However, the method is not restricted to two sheets. Further, the two sheets are also not required to be of the same thickness. Additionally, the joints to be produced can be circular requiring the active tool faces to also have circular section shapes. However, the joint shapes are not required to be circular and other joint shapes may also be produced. The free space is also not required to be closed in itself but may consist of two short straight parallel channels. The rectangular section shape of the free space may also be modified.

In all embodiments of the present invention, the joint boss protrudes with very little height beyond the sheet surface or surfaces. Further, in all embodiments, the entire joining action occurs within a space delimited by the outer surfaces of the two metal sheets.

In order to join the superposed metal sheets, a tool set is required which is comprised of a top die and a bottom die. It must be kept in mind, however, that these designations simply serve the purpose to distinguish the two dies: the tool set works equally well upside down or in any other position. Further, it should also be noted that the joint need not be formed in only one workstation: two successive stations could be provided, one each for a respective method step. The foregoing remarks are applicable for all embodiments here disclosed.

Figure 1:
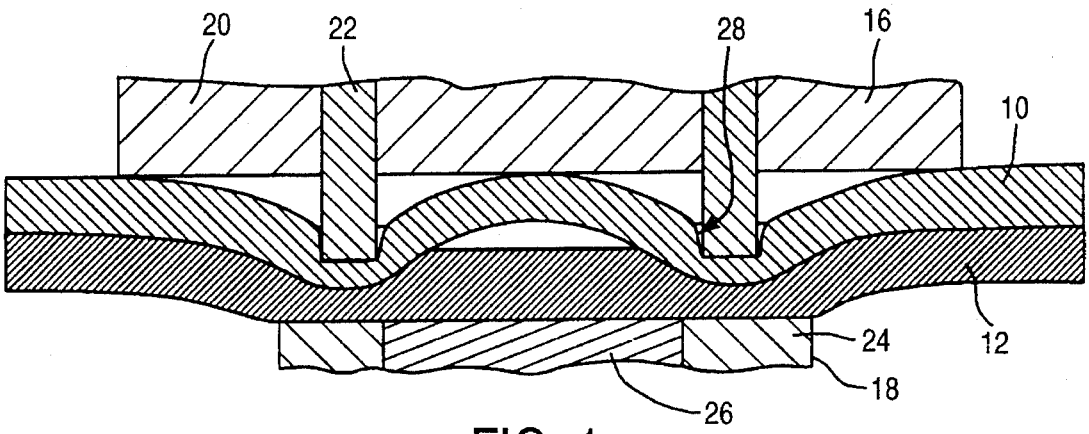
FIGS. 1 and 2 illustrate the method according to the first variant of the present invention.

Referring now to FIG. 1, a first step of a first variant is illustrated. Initially, two sheets 10 and 12 are clamped between a top clamping member portion 20 of top die 16 and a bottom clamping member 24 of bottom die 18. Thereafter, tubular top punch member 22 is pushed (by means not shown) towards sheet 10 so as to penetrate into sheet 10 forming a circular ring-shaped depression which constitutes free space 28 when the top punch member 22 is withdrawn. The dislocated material causes bulging of the surrounding sheet portions, as shown. It is to be noted that no undercut or form lock is caused between sheets 10 and 12 at this stage.

Figure 2:
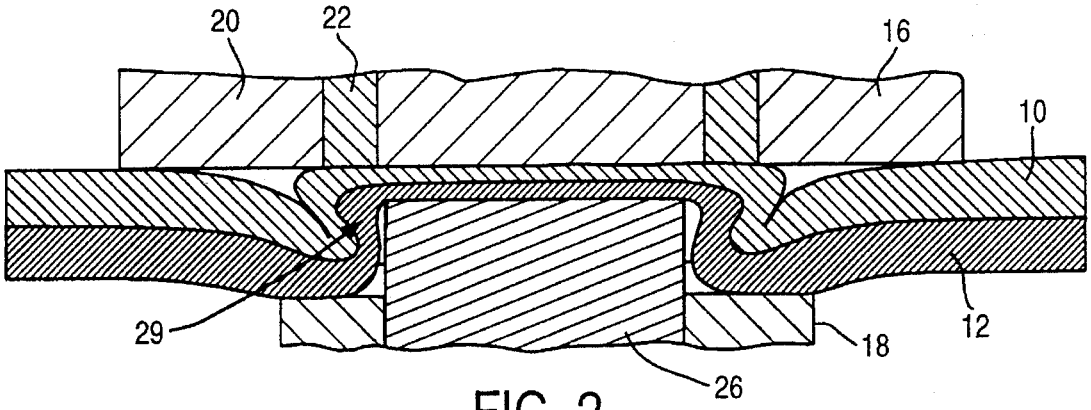

Such form lock, however, is produced in the second step illustrated in FIG. 2. A cylindrical bottom punch member 26 which, in the first step, was flush with the bottom clamping member 24, is displaced towards sheet 12 and until it penetrates into sheet 12. It is to be noted that the cylindrical bottom punch member 20 has a diameter slightly smaller than the inner diameter of tubular top punch member 22. During this second step, top clamping member 20 and top punch member 22 lie flush with their fronts facing sheet 10. Bottom clamping member 24 may yield slightly so as to give way to the bulging sheet 12. The volume portion of sheets 10 and 12 within free space 28 is squeezed, and the metal flows in lateral direction and forms the interengaging form lock 29. It will be noted that after withdrawal of dies 16 and 18, the joint will be flush with the upper or outer surface of sheet 10.

Figure 3:
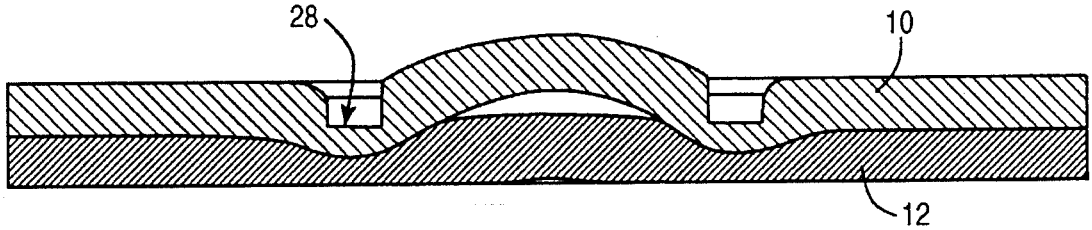
FIGS. 3 and 4 illustrate the method according to the second variant of the present invention.
Figure 4:
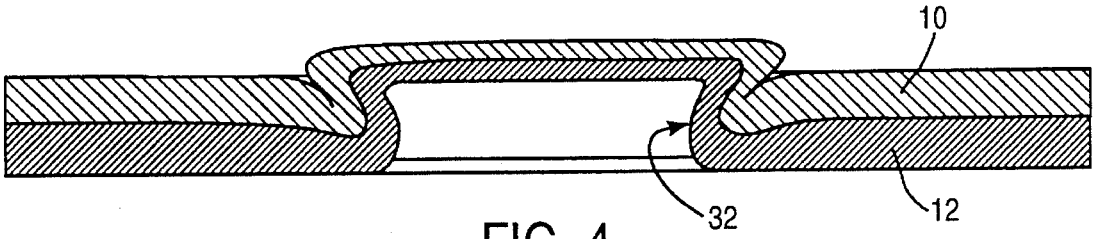

In the embodiment of FIGS. 3 and 4, bottom clamping member 24 (not shown) is held stationary during the second step as discussed above while top punch member 22 (not shown) together with the portion of the top clamping member 20 (not shown) encircled by it may slightly yield so that once the joint is formed recess 32 is flush with the surrounding portions of sheet 12, the boss being formed on the side of sheet 10.

Figure 5:
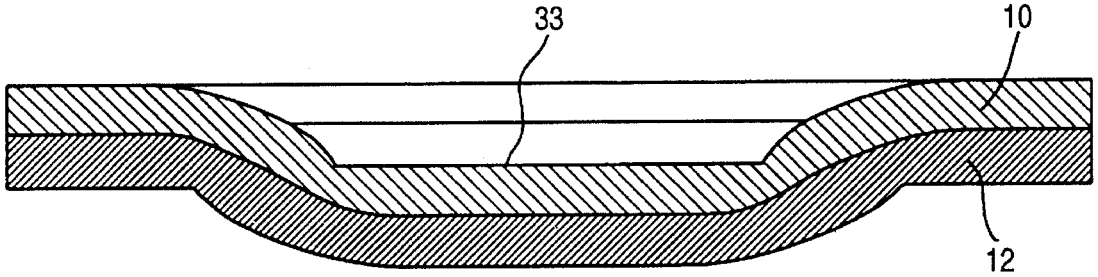
FIGS. 5–7 illustrate the method according to the third variant of the present invention.
Figure 6:
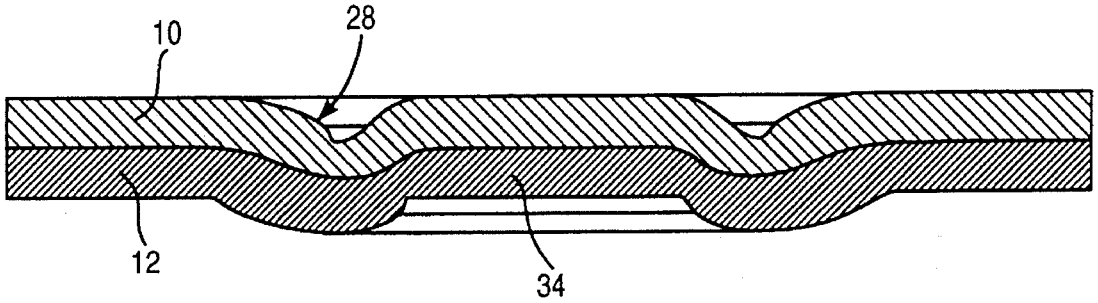
Figure 7:
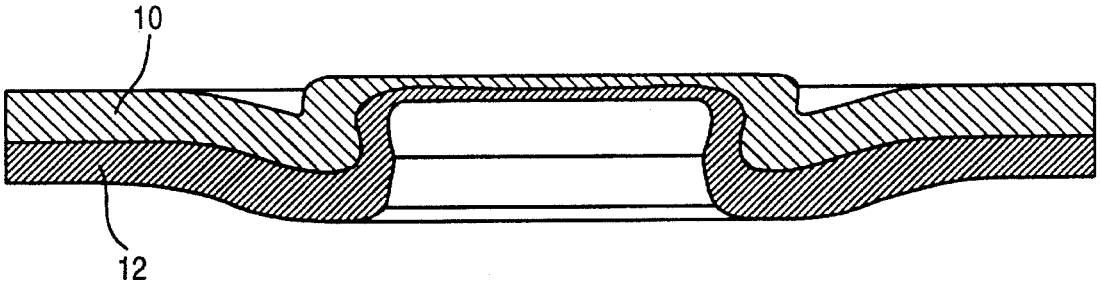

The embodiment of FIGS. 5, 6 and 7 comprises three steps. In a first step illustrated in FIG. 5, a cup-shaped depression 33 is formed thereby defining the outer boundary of the to-be-formed free space. In a second step, a central portion 34 of the "cup bottom" is relocated by bottom punch member 26 (not shown) thereby defining the inner boundary of free space 28 (FIG. 6) until the portion of sheet 10 on top of portion 34 hits the top clamping member 20 (not shown). Further displacement of the bottom punch member squeezes the sheets to form the interlock illustrated in FIG. 7. It is to be noted that very flat bosses remain on both sides of the joint.

Although the foregoing invention has been described in some detail by way of illustration and example, for purposes of clarity of understanding, it will be obvious that certain changes and modifications may be practiced within the scope of the appended claims.

What is claimed is:

1. A method for joining a plurality of superposed metal sheets by local plastic deformation so that an interengaging connection is formed, the method comprising the steps of:

providing a plurality of superposed metal sheets;

producing a free space in at least one of said sheets by local plastic deformation, said free space having an outer wall surrounding and encompassing substantially entire surface of an inner wall in at least one of said sheets, said inner wall being spaced-apart from said outer wall by said free space, said free space at least partly defining an area where an interengaging connection is to be formed; and plastically deforming said superposed metal sheets to make sheet metal within said area to flow towards said outer wall thereby forming said interengaging connection of said superposed metal sheets.

2. A method as in claim 1, wherein said free space is formed as a channel.

3. A method as in claim 2, wherein a plurality of separate free spaces is provided.

4. A method as in claim 1, wherein said free space is formed as a closed loop.

5. A method as in claim 1, wherein a plurality of separate free spaces is provided.

6. A method as in claim 1, wherein one of said sheets defines an outer sheet surface and wherein said interengaging connection is formed flushed with said outer sheet surface.

7. A method as in claim 1, wherein said sheets define an upper sheet surface and a lower sheet surface and wherein said interengaging connection is formed substantially flush with said upper sheet surface and with said lower sheet surface.

8. A method as in claim 1, wherein said free space in annular in geometry.

9. A tool set for joining a plurality of superposed metal sheets by local plastic deformation so that an interengaging connection is formed, said tool set comprising:

a first die having a first clamping member arranged to abut a first outer surface of said sheets, and a first punch member having an annular section and arranged to penetrate into said sheets from said first outer surface thereby leaving an annular free space in said superposed metal sheets when said punch member is retracted;

a second die having a second clamping member arranged to abut a second outer surface of said sheets opposite said first outer surface, and a second punch member arranged to penetrate into said sheets from said second outer surface and within an area delimited by said annular free space thereby squeezing said sheets against said first clamping member so as to make sheet metal flow outwards into said free space.

10. A tool set as in claim 9, wherein said second punch member is cylindrical having a diameter which is smaller than an inner diameter of said annular section of said first punch member.

* * * * *